US005521348A

United States Patent [19]

Berndt et al.

[11] Patent Number: 5,521,348

[45] Date of Patent: May 28, 1996

[54] MULTI-POLE VACUUM SWITCH WITH AN INSULATION ASSEMBLY SURROUNDING EACH VACUUM INTERRUPTER

[75] Inventors: Klaus-Günther Berndt; Detlev Schmidt; Kathrina Marek, all of Berlin; Johannes Banghard, Friedrichsthal; Michael Hahn, Berlin, all of Germany

[73] Assignee: Siemens Aktiengesellschaft, München, Germany

[21] Appl. No.: 307,817

[22] PCT Filed: Mar. 12, 1993

[86] PCT No.: PCT/DE93/00240

§ 371 Date: Jan. 17, 1995

§ 102(e) Date: Jan. 17, 1995

[87] PCT Pub. No.: WO93/20570

PCT Pub. Date: Oct. 14, 1993

[30] Foreign Application Priority Data

Mar. 27, 1992 [DE] Germany ..... 42 10 716.4

[51] Int. Cl.[6] ..... H01H 33/66

[52] U.S. Cl. ..... 218/119; 218/120; 218/139

[58] Field of Search ..... 200/303, 307; 218/118, 119, 120, 134, 139, 140, 152, 153, 154

[56] References Cited

U.S. PATENT DOCUMENTS

| | | | |
|---|---|---|---|
| 3,443,048 | 5/1969 | Rogers et al. | 200/168 |
| 3,560,682 | 2/1971 | Kohler et al. | 218/10 |
| 3,895,199 | 7/1975 | Frewe et al. | 218/119 |
| 4,593,165 | 6/1986 | Steinemer | 218/140 |

FOREIGN PATENT DOCUMENTS

| | | |
|---|---|---|
| 2211413 | 4/1975 | Germany . |
| 2322372 | 10/1976 | Germany . |
| 3111791 | 10/1982 | Germany . |
| 3414016 | 10/1985 | Germany . |

*Primary Examiner*—J. R. Scott
*Attorney, Agent, or Firm*—Kenyon & Kenyon

[57] ABSTRACT

A multi-pole vacuum switch has an insulation assembly for each pole, which is composed of shell-like insulating elements. In addition to a space provided for receiving the vacuum interrupter, chambers are formed by wall sections, which are provided for receiving mechanical and electrical components of a pole unit. In particular, these electrical components are a loop-shaped, flexible strip conductor, a lever arrangement, contact springs and current transformers. Tensioning bolts which penetrate all the pole units connect the pole units to a pole block. The invention is suitable for use in vacuum power switches, in particular for low operating voltages.

6 Claims, 4 Drawing Sheets

MULTI-POLE VACUUM SWITCH WITH AN INSULATION ASSEMBLY SURROUNDING EACH VACUUM INTERRUPTER

BACKGROUND OF THE INVENTION

The present invention relates to a multi-pole vacuum switch having one vacuum interrupter per pole. Each vacuum interrupter has an essentially cylindrical housing and cylindrically shaped end flanges which terminate the housing axially and a connection bolt which extends through one of the end flanges and is displaceably mounted for switching the vacuum switch on and off. Each of the vacuum interrupters is surrounded by an insulation assembly. The insulation assemblies for all the poles are arranged one next to the other and include a connection chamber arranged in the axial extension of the associated vacuum interrupter. The displaceable connection bolt of the vacuum interrupter projects into the connection chamber. The connection chamber includes a loop-shaped, flexible strip conductor for connecting the displaceable connection bolt to an external connection element. A drive device, which is common to all poles, switches the vacuum interrupters on and off for all the poles. A drive lever is provided for each of the vacuum interrupters, which is pivotably mounted in the associated insulation assembly.

A vacuum switch of this kind is shown in, for example, German Patent No. DE-B-23 22 372. The insulation assemblies for the shown vacuum switch are of essentially cylindrical design and are divided transversely with respect to the longitudinal axis. The head part of each insulation assembly contains a bearing point for a two-armed lever for driving the associated vacuum interrupter. A lever part, which projects out of the head part is connected to a drive rod of the drive device. A plurality of such pole units are attached to a drive housing in accordance with the desired number of poles.

In view of German Patent No. DE-B- 23 22 372, an object of the present invention is based on simplifying the installation of the vacuum interrupters in the insulation assembly while maintaining the principle of protecting the vacuum interrupters on all sides. At the same time, it is an object of the present invention to provide conditions for largely integrating assemblies relating to the vacuum switch poles, such as connection devices, contact springs, drive components for the interrupters, or similar assemblies.

SUMMARY OF THE INVENTION

These and other objects are achieved by the vacuum switch of the present invention. The vacuum switch of the present invention is of the type described above having the following further features. Each insulation assembly comprises two shell-like insulating elements which receive the associated vacuum interrupter between them. Each insulation assembly has at least one approximately semicylindrical recess matched to one of the end flanges of the vacuum interrupter. A strip conductor is arranged in the connection chamber having legs which extend transversely with respect to the longitudinal axis of the vacuum interrupter in such a way that forces resulting from a current flowing through the strip conductor can be used to compensate contact-breaking forces within the vacuum interrupter. The insulating elements are each provided with at least two through-openings for receiving tensioning bolts which penetrate all of the insulating elements. A pole block is provided which is formed from the insulation assemblies and is arranged between side walls, which are designed to protrude beyond the pole block for attaching to the drive device.

Because of the longitudinal division of the insulation assembly, the entire current path of a pole can be installed in one of the shell-like insulating elements before the other shell-like insulating element is fitted on and an enclosed pole unit is formed. A plurality of such pole units can be joined one to the other and are then connected by tensioning bolts to form a pole block. Because of this design, the vacuum switch is divided up essentially into two large assemblies, i.e., the pole block with the protruding side walls and the drive device which is to be attached between the side walls. During the assembly of the pole block with the drive device, it is only necessary to make one mechanical connection to the drive kinematics which are pole-related and contained in each pole unit.

Furthermore, in contrast to the arrangement provided in the case of the vacuum switch according to the German Patent No. DE-B-23 22 372 mentioned above, where legs of the flexible conductor are arranged to run parallel to the longitudinal axis of the vacuum interrupter, it is achieved that the disengaging forces between the contact members of the vacuum interrupter, which are produced by a short-circuit current, are able to be compensated by means of the loop forces.

It is advantageous if the insulating elements are dimensioned to protrude beyond the associated vacuum interrupter (if the protruding areas are bounded at least partially by wall sections to form chambers), and if the shape of the chambers is matched to electrical and/or mechanical components which are provided for operating the vacuum interrupter.

Such an additional chamber can be, for example, a measurement chamber which is arranged adjacent to the connection chamber and can receive a current transformer. This arrangement is particularly expedient in conjunction with a connection element which is an extension of the longitudinal axis of the vacuum interrupter or extends parallel thereto. It provides the possibility of plugging a current transformer on to the connection element when required, and replacing it easily.

The measurement chamber which is provided for receiving a current transformer can be closed off from the outside by an insulating closure element which is to be connected to the shell-like insulating elements and has a feedthrough opening for the associated connection element. The closure element not only supports the connection element but also secures the current transformer. The supporting function for the connection element is also realized if no current transformer is used and only the empty measurement chamber is bridged by the closure element.

The insulation assemblies can be provided with additional chambers. In particular, to the side of the space which is intended for receiving the associated vacuum interrupter, the insulation assembly can receive a spring chamber for receiving at least one spring which provides the contact force of the vacuum interrupter. On the opposite side, the insulation assembly can receive a drive chamber for receiving a lever arrangement which transmits the drive movement of the drive device to the vacuum interrupter. The lever arrangement here can be designed in such a way that a convenient connection or coupling to the drive device is produced. In addition, the insulation assemblies can have, in each case underneath the spring chamber, a wall section with an undercut for the engagement of a bolt which serves as a fixed counterbearing of a contact spring.

DETAILED DESCRIPTION

Figure 1:
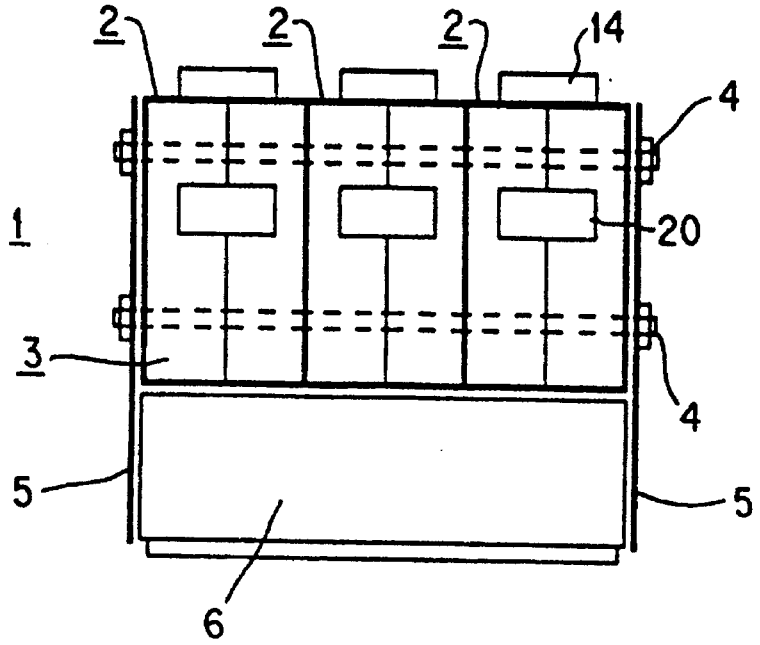
FIG. 1 is a diagrammatic plan view of a multi-pole vacuum switch.

The vacuum switch 1 shown in FIG. 1 has a three pole design and has three pole units 2 which are arranged one next to the other without spacing. The pole block 3, which is formed in this way, is held together by tensioning bolts 4 which penetrate the pole units 2 and also, at the same time, grip side walls 5 which form the lateral termination of the pole block 3 and which are designed to protrude beyond the pole block 3. Between the protruding sections of the side walls 5 there is a drive device 6 which serves in a known manner to switch on and off the vacuum interrupters contained in the pole units 2.

The components of one of the pole units 2 are explained in greater detail below with reference to FIGS. 2 to 5, and the basic design is described with reference to FIGS. 2 and 3.

The pole unit 2 has a vacuum interrupter 10 which has a housing 11 with an upper end flange 12 and a lower end flange 13. The lower end flange 13 is also one connection point of the vacuum interrupter 10. A connection bar 14 bent at a right angle is provided as a connection device. A displaceably mounted connection bolt 15, to which the one leg 16 of a flexible strip conductor 17 is attached, extends through the upper terminating flange 12. The strip conductor 17 has an approximately loop-shaped design and has a shorter leg 18 which is located opposite and approximately parallel to the leg 16 and is coupled to a straight connection bar 20. The connection bar 20 extends upwards, parallel to the extension of the longitudinal axis of the vacuum interrupter 10, while the legs of the strip conductor 17 are arranged running transversely with respect to this longitudinal axis.

The components described above form the current path of the pole unit 2. This current path is contained in an insulation assembly 23 formed from two approximately shell-shaped insulating elements 21 and 22. First, the shape of the insulating element 22 will be explained in greater detail with reference to FIGS. 4 and 5.

Figure 5:
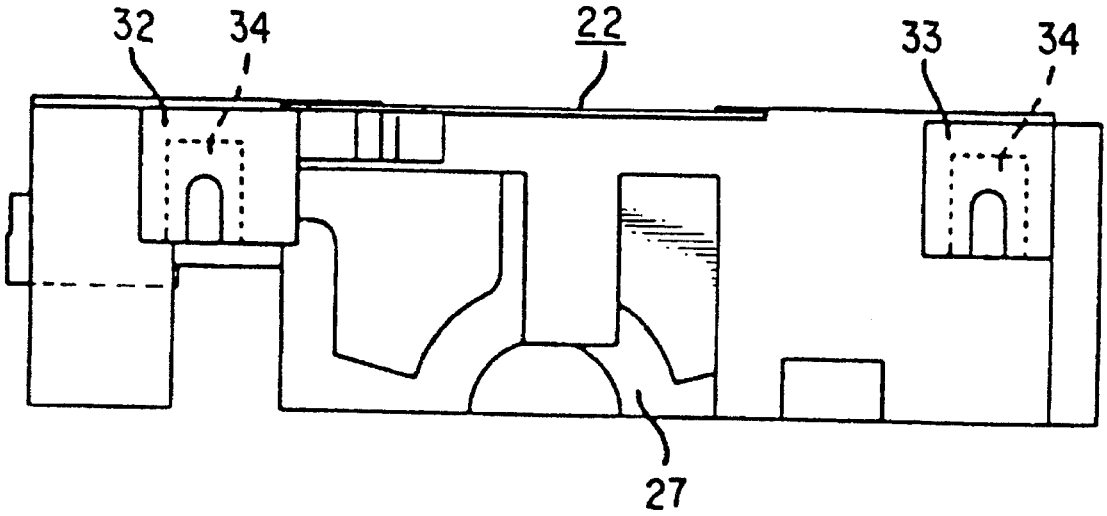
FIG. 5 shows the insulating element according to FIG. 4 from above.
Figure 4:
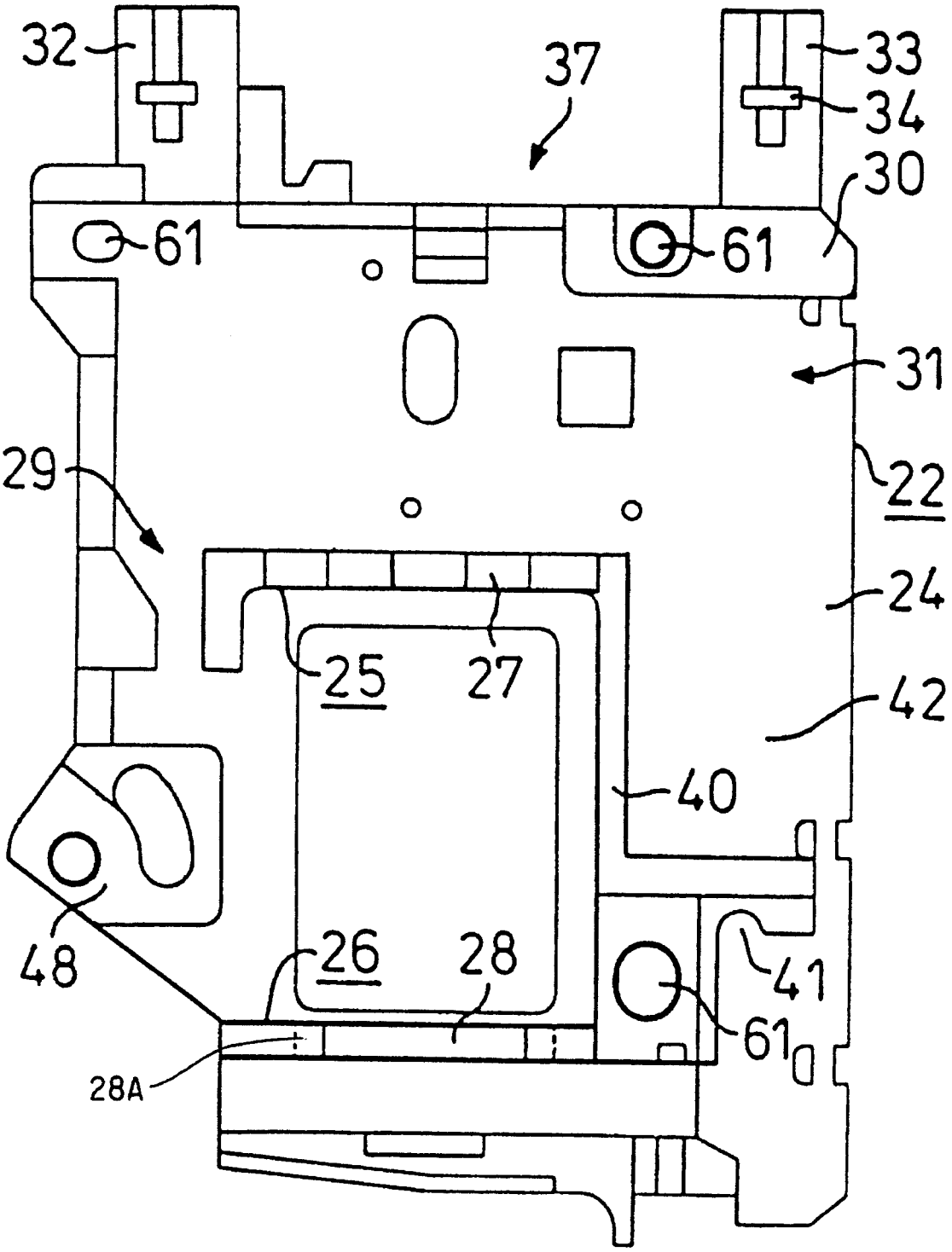
FIG. 4 shows one of the shell-like insulating elements from which the insulation assembly of the pole unit according to FIGS. 2 and 3 is composed.

As can be seen from FIGS. 4 and 5, the first insulating element 22 has wall sections which project out of an essentially planar wall component 24, and a number of spaces or chambers are formed therein. Two wall sections 25 and 26 are provided here with approximately semicircular recesses 27 and 28 which are matched to the shape of the end flanges 12 and 13 of the vacuum interrupter 10. A space for receiving the vacuum interrupter 10 is formed by the wall sections 25 and 26, in conjunction with corresponding wall sections of the associated mirror-inverted insulating element 21. If both semicircular recesses are dimensioned to match the end flanges 12 and 13, the vacuum interrupter 10 is clamped tight at both ends. In contrast, if it is desired to secure only one end (for example the end flange 12) of the vacuum interrupter 10, the recess 28 can be of a widened design 28A, as is shown by broken lines in FIG. 4.

Figure 2:
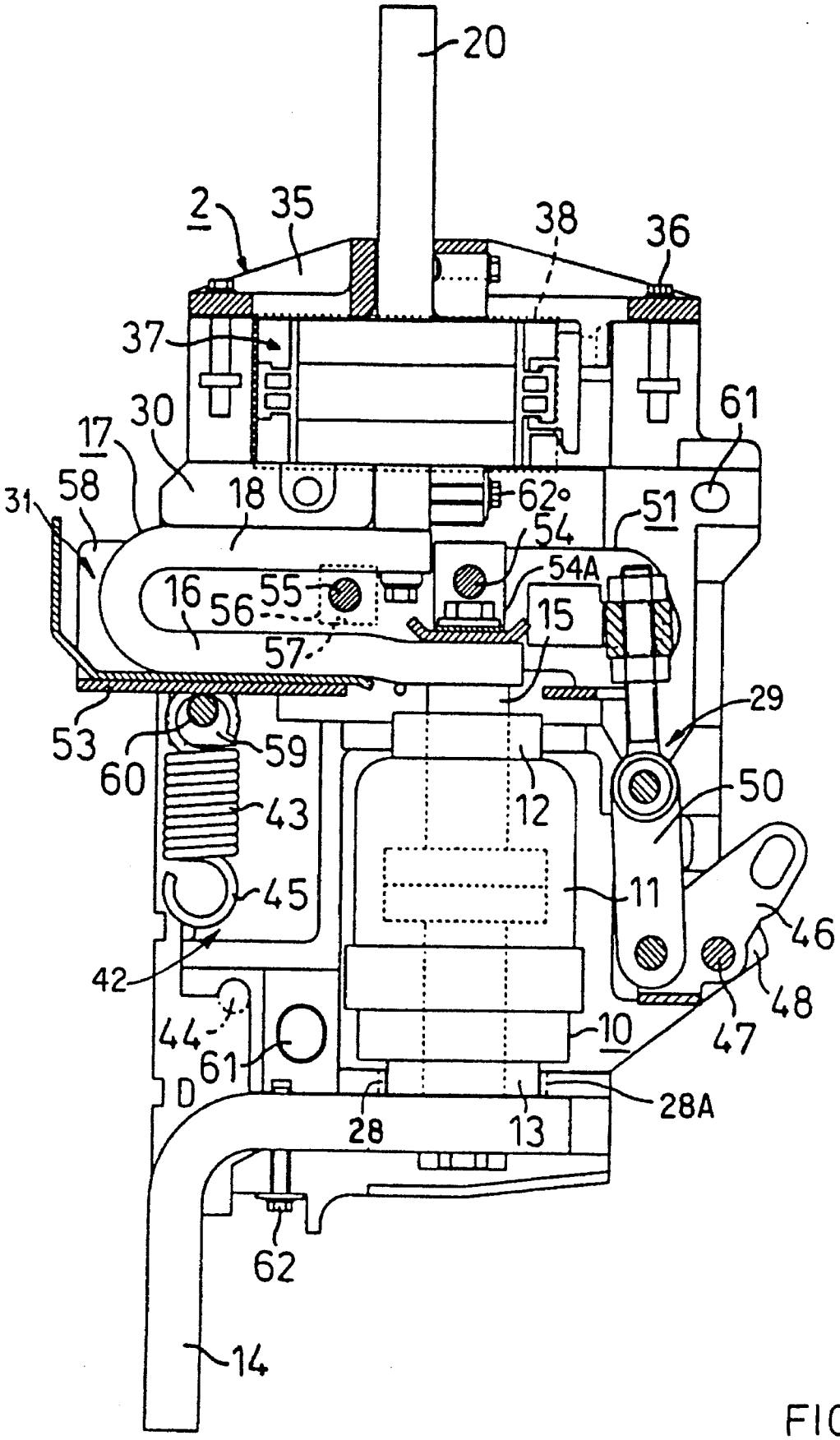
FIG. 2 shows a pole unfit of the multi-pole vacuum switch according to FIG. 1 in the opened state.
Figure 3:
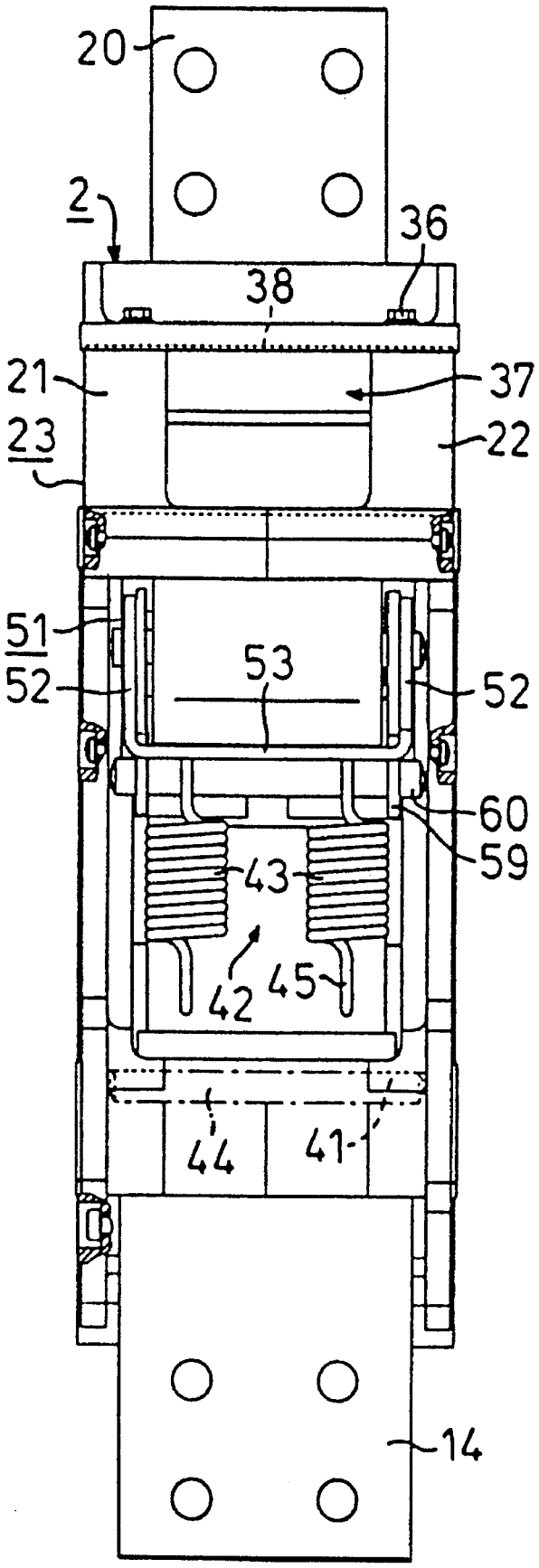
FIG. 3 illustrates the pole unit according to FIG. 2 in the closed state with a view of the narrow sides.

A further wall section 30, which is arranged approximately parallel to the wall section 25, bounds a connection chamber 31 which is provided for receiving the flexible strip conductor 17 shown in FIG. 2. Towards its bottom, the connection chamber 31 is connected to a drive chamber 29 which is located to the side of the vacuum interrupter 10. Upper wall components 32 and 33 extend approximately parallel to the longitudinal axis of the vacuum switching chamber 10 (FIG. 2) and each of the upper wall components contain a recess 34 for inserting a nut. FIGS. 2 and 3 show that a measurement chamber 37 is formed by fitting on a closure element 35 which extends beyond the entire width of the insulation assembly 23 and is connected to the insulating elements 21 and 22 via a total of four attachment screws 36. A current transformer 38, whose contours are shown by a broken line, can be accommodated in the measurement chamber 37. The wall section 30 and the closure element 35 have flush openings for the aforementioned upper connection bar 20 to pass through.

In addition, FIG. 4 shows, on the right-hand side of the space which is provided for receiving the vacuum interrupter, an angular wall section 40 on whose underside an undercut 41 is located. As a result, a spring chamber 42 is formed which serves, in accordance with FIGS. 2 and 3, to receive two contact springs 43. The contact springs 43 are shown in the untensioned state, which results after the installation of the current path and the connection of the movable connection bolt 15 to parts which will be explained later. The pretensioning of the contact springs 43, which is required for operation, is brought about by inserting a bolt 44, indicated by dot-dashed lines, into lower eyelets 45 of the two contact springs 43 and by hooking this bolt into the undercuts 41 of both of the associated insulating elements 21 and 22. In addition, it is assumed in FIGS. 2 and 3 that the drive parts are free of forces and therefore the vacuum interrupter 10 is under the influence of atmospheric air pressure in the switched-on state.

The drive device 6, which is shown diagrammatically in FIG. 1, interacts, according to FIG. 2, with one coupling lever 46 of each of the pole units 2. The coupling lever 46 is pivotably mounted on a bolt 47 (FIG. 2) which engages at both ends in bearing eyes 48 of the insulating elements 21 and 22. One of the bearing eyes 48 is shown in FIG. 4. An adjustable coupling rod 50, which extends approximately parallel to the longitudinal axis of the vacuum interrupter 10, is located in the drive chamber 29 and connects the coupling lever 46 to a drive lever 51 located in the connection chamber 31. The drive lever 51 is formed of an approximately U-shaped sheet-metal part and has legs 52 and a central part 53 which does not need to extend beyond the entire length of the legs 52. The drive lever 51 is mounted by a bearing bolt 54 on the displaceable connection bolt 15 using a mounting element 54A. A further articulation bolt 55 extends through the legs 52 and engages with its ends in each case one window-like recess 56 which is shown by broken lines and whose lower edge forms a stop face 57 for the articulation bolt 55. An end part 58, which protrudes beyond the articulation bolt 54, of the drive lever 51 serves as counterbearing for the aforesaid contact springs 43, specifically either directly or by the illustrated clips 59 in conjunction with a bolt 60 which connects the clips 59.

The flexible strip conductor 17 is located essentially between the legs 52 of the drive lever 51 and is in this way accommodated in a very space-saving manner. The desired function is achieved in that the lower leg 16 of the strip conductor 17 can be supported against the central part 53 while the upper leg 18 rests against the wall section 30. A force which spreads apart the legs 16 and 18 of the strip conductor 17 and is dependent on the respective current flowing presses the drive lever 51 downwards in such a way that the contact force of the vacuum interrupter 10 is increased.

In the switched-on state, the articulation bolt 55 is at a specific distance from the stop face 57 so that the bearing bolt 54 forms the pivot bearing of the drive lever 51. If the drive device 6 (FIG. 1) is released for switching the vacuum interrupter off, which corresponds to the coupling lever 46 being released, the right-hand end, connected to the coupling rod 50, of the drive lever 51 is no longer secured. The drive lever 51 then pivots about its bearing bolt 54 in a counter clockwise direction until the articulation bolt 55 comes to rest against the stop face 57 and the stop face 57 now forms the pivot bearing of the drive lever 51. The contact springs 43 now act in an opening fashion with the lever arm of the end part 58 of the drive lever 51. The use of springs in such a way that they act both as contact springs and as switch-off springs is known per se in vacuum switches and can be found, for example, in German Patent No. DE-A-34 14 016.

For receiving the tensioning bolts 4 shown in FIG. 1, the insulating elements 21 and 22 are provided with flush through-openings 61. The insulating elements 21 and 22 are held together by connecting screws 62 before being ultimately connected by the tensioning bolts 4. The connecting screws 62 penetrate the wall sections of the insulating elements 21 and 22 and engage in the connection bars 14 and 20.

As is clear from the description above, the use of the insulating elements permits a very space-saving arrangement of the vacuum interrupters including their associated assemblies. At the same time, the loop-shaped strip conductor is integrated into the drive parts virtually without additional space being required. Therefore, the invention is particularly suitable for the construction of compact switching devices, e.g. for circuit breakers in the voltage range of up to 1000 V.

We claim:

1. A multi-pole vacuum switch comprising:

a vacuum interrupter for each pole of the multi-pole vacuum switch, where each vacuum interrupter comprises:

an essentially cylindrical housing having cylindrically shaped upper and lower end flanges; and a connection bolt extending through said upper end flange, said connection bolt being displaceably mounted for switching said vacuum interrupter on and off;

a drive device coupled to each pole of said multi-pole vacuum switch, said drive device capable of switching each of said vacuum interrupters on and off; and an insulation assembly surrounding each of said vacuum interrupters, such that the insulation assemblies for all of said vacuum interrupters are arranged one next to another, where each said insulation assembly comprises:

a connection chamber arranged in a position which is axially displaced with respect to the vacuum interrupter, where said connection bolt of said vacuum interrupter projects into said connection chamber, said connection chamber includes a loop-shaped flexible strip conductor capable of coupling said connection bolt to an external connection element;

a drive lever coupled to the drive device of said vacuum interrupter, said drive lever being pivotably mounted in said insulation assembly;

first and second shell-like insulating elements, each having at least one semicylindrical recess capable of receiving one of said lower and upper end flanges, such that said first and second shell-like insulating elements receive said vacuum interrupter between them;

said strip conductor of said vacuum interrupter being arranged in said connection chamber, where said strip conductor includes first and second legs extending transversely with respect to a longitudinal axis of the vacuum interrupter, such that forces resulting from a current flowing through said strip conductor are capable of compensating contact-breaking forces within said vacuum interrupter; and each of said insulating elements includes at least two through-openings capable of receiving tensioning bolts which penetrate all of said insulating elements in said multi-pole vacuum switch, such that a pole block is formed of said insulating assemblies arranged between at least two side walls, said side walls protruding beyond said pole block for attachment to said drive device.

2. The multi-pole vacuum switch of claim 1, wherein a portion of each of said first and second insulating elements protrude beyond the surrounded vacuum interrupter, such that said portions are bound at least partially by wall sections of said first and second insulating elements to form at least one additional chamber, such that a shape of each additional chamber corresponds to electrical and mechanical components for operating said vacuum interrupter.

3. The multi-pole vacuum switch of claim 2, wherein one of said additional chambers is a measurement chamber which receives a current transformer, said measurement chamber being arranged adjacent to said connection chamber, where said measurement chamber is penetrated by said connection element, said connection element is an extension of the longitudinal axis of said vacuum interrupter and is coupled to the first leg of said flexible strip conductor.

4. The multi-pole vacuum switch of claim 3, wherein said measurement chamber is terminated by an insulating closure element which is releasably attached to both of said first and second insulating elements of said insulation assembly, where said insulating closure element has a feedthrough opening for said connection element.

5. The multi-pole vacuum switch of claim 1, wherein each insulation assembly includes a spring chamber adjacent to a space for receiving said vacuum interrupter, said spring chamber receiving at least one contact spring providing a contact force to the vacuum interrupter, and a drive chamber adjacent to said space for receiving said vacuum interrupter and opposite to said spring chamber, said drive chamber receiving a lever arrangement coupled to the drive device and to said contact spring for transmitting drive movement and contact force to the vacuum interrupter.

6. The multi-pole vacuum switch of claim 5, wherein said insulation assembly includes an undercut for engaging an additional bolt, said additional bolt acting as a fixed counterbearing of said contact spring and is arranged on a wall section which bounds said spring chamber.

* * * * *